US008485853B2

(12) United States Patent
Seifert et al.

(10) Patent No.: US 8,485,853 B2
(45) Date of Patent: Jul. 16, 2013

(54) ELECTRICAL CONTACT HAVING KNURL PATTERN WITH RECESSED RHOMBIC ELEMENTS THAT EACH HAVE AN AXIAL MINOR DISTANCE

(75) Inventors: Kurt P. Seifert, Cortland, OH (US); William J. Palm, Warren, OH (US); Lisa L. Flauto, Boardman, OH (US); Bruce J. Serbin, Canfield, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 13/288,561

(22) Filed: Nov. 3, 2011

(65) Prior Publication Data

US 2013/0115828 A1 May 9, 2013

(51) Int. Cl.
*H01R 4/10* (2006.01)

(52) U.S. Cl.
USPC ..... 439/882

(58) Field of Classification Search
USPC ..... 439/877, 878, 882
See application file for complete search history.

(56) References Cited

U.S. PATENT DOCUMENTS

| | | | | |
|---|---|---|---|---|
| 6,056,605 | A * | 5/2000 | Nguyen et al. | 439/882 |
| 6,910,925 | B2 * | 6/2005 | Endo et al. | 439/856 |
| 7,160,150 | B2 | 1/2007 | Annequin | |
| 7,513,792 | B2 | 4/2009 | Kumakura | |
| 7,722,416 | B2 * | 5/2010 | Gump et al. | 439/879 |
| 8,052,466 | B2 * | 11/2011 | Okamoto | 439/585 |
| 8,177,591 | B2 * | 5/2012 | Okamura et al. | 439/877 |
| 8,303,354 | B2 * | 11/2012 | Ootsuka et al. | 439/877 |
| 2005/0273122 | A1 | 12/2005 | Theroux et al. | |
| 2010/0087104 | A1 | 4/2010 | Gump et al. | |
| 2010/0087105 | A1 | 4/2010 | Gump et al. | |
| 2011/0083324 | A1 | 4/2011 | Martauz et al. | |

FOREIGN PATENT DOCUMENTS

| | | |
|---|---|---|
| EP | 0 544 521 | 2/1993 |
| JP | 2003-243057 | 8/2003 |
| WO | 2009-128344 | 10/2009 |
| WO | WO 2010010758 A1 * | 1/2010 |

OTHER PUBLICATIONS

International Search Report dated Nov. 27, 2012.

* cited by examiner

*Primary Examiner* — Neil Abrams
*Assistant Examiner* — Travis Chambers
(74) *Attorney, Agent, or Firm* — Thomas N. Twomey

(57) ABSTRACT

An electrical contact includes a knurl pattern disposed along at least a portion of an interior surface of the electrical contact. The portion receives a lead of a wire cable along a longitudinal axis and is attached thereto to form a crimp connection. The knurl pattern includes a plurality of recessed elements and each recessed element has a rhombus shape that includes inner corners. An orientation of a first pair of opposing, generally axial inner corners define an axial minor distance therebetween and an orientation of a second pair of opposing, inner corners define a major distance therebetween. The axial minor distance is less than the major distance. The recessed elements of the knurl pattern are especially suitable for engagement with an aluminum wire cable to form the crimp connection. A wire assembly that includes the crimp connection is associated with a cable harness disposed in a motorized vehicle.

17 Claims, 6 Drawing Sheets

ELECTRICAL CONTACT HAVING KNURL PATTERN WITH RECESSED RHOMBIC ELEMENTS THAT EACH HAVE AN AXIAL MINOR DISTANCE

TECHNICAL FIELD

This invention relates to an electrical contact that includes a knurl pattern, more particularly, the electrical contact includes a knurl pattern having a plurality of recessed elements that contain an axial minor distance defined between a first pair of opposing, generally axial inner corners that is less than a major distance defined between a second pair of opposing inner corners different from the first pair of inner corners.

BACKGROUND OF INVENTION

It is known to engagingly attach a terminal to a wire conductor by a crimp to form an electrical connection.

Wire conductor/terminal crimps are common in wiring harnesses used in many industries, such as the automotive, trucking, and airline industries. Wiring harnesses provide the conduit for electrical signal transmission that support the operation of electrical devices in electrical systems in these industries. In the automotive industry, it is increasingly desirable to use lighter weight wire conductors that may assist to provide desired increased fuel economy for a vehicle. These lower mass aluminum wire conductors are often electrically connected to commercially available non-aluminum terminals. The wire conductor is electrically and mechanically connected to the terminal to form the electrical connection. When aluminum wire conductors are used in electrical applications, knurl patterns may assist to break up undesired aluminum oxides formed on the aluminum wire conductor that allow formation of an acceptable electrical connection of the wire conductor to the terminal. Aluminum oxides that are not broken-up when the electrical connection is formed may degrade the performance of the electrical connection such that transmission of an electrical signal through the wire conductor/terminal electrical connection is undesirably degraded or prohibited.

Another undesired characteristic that may degrade the electrical performance of the wire conductor/terminal crimp may be voids that form in the knurl pattern during formation of the crimp. Referring to prior art FIGS. 1 and 1A, a conventional knurl pattern contains knurl elements (1) that each have a recessed square pyramid-type shape that may contain voids (2) in the crimp (3) where portions of the aluminum lead (4) do not engage in the square pyramid-type recessions when the lead (4) is crimped to the terminal (5). When the knurl pattern is constructed, the recessed tips of the square pyramid-type knurl elements point in a direction away from the interior surface of the terminal. These undesirable voids (2) do not contain a portion of lead (4), and thus, cannot electrically connect the aluminum lead (4) with the terminal (5) in the crimp (3). Multiple voids prevent achievement of a desired maximum electrical and mechanical connection between the aluminum lead (4) and the terminal (5) as may be the case if, in contrast, the voids were filled with portions of the aluminum lead. Additionally, the surface area of the lead (4) in the local vicinity of the void may also contain aluminum oxides that are not broken up when the wire conductor/terminal electrical connection is formed. As aluminum wire conductor continues to gain popularity with vehicle manufacturers and aluminum oxides remain a prevailing problem that may prevent acceptable wire conductor/terminal electrical connections, it remains a very desirable goal to maximize the break-up of aluminum oxides while also further improving the electrical and the mechanical properties of the wire conductor/terminal or wire cable/terminal electrical connection over the service life of the vehicle.

Thus, what is needed is an electrical contact that overcomes the above mentioned shortcomings and includes a knurl pattern where each element in the knurl pattern has a shape and a shape orientation relative to a wire cable received in to the electrical contact that allows for a more complete break-up of aluminum oxides on a substantial portion of the lead of the wire cable while also providing an improved electrical and mechanical connection between the aluminum wire cable and the electrical contact.

SUMMARY OF THE INVENTION

In accordance with one embodiment of the invention, an electrical contact includes a knurl pattern disposed along at least a portion of an interior surface of the electrical contact along a length of the electrical contact. The portion receives a lead of a wire cable along the axis. The knurl pattern includes a plurality of elements that are recessed rhombic elements. Each recessed element has a shape that includes inner corners. A first pair of opposing, generally axial inner corners define an axial minor distance therebetween and a second pair of opposing, inner corners define a major distance therebetween wherein the axial minor distance is less than the major distance.

The recessed rhombic elements of the knurl pattern of the electrical contact are especially suitable for engagement with an aluminum wire cable to form the crimp connection.

A wire assembly that includes the crimp connection is associated with a cable harness disposed in a motorized vehicle. When the lead is engaged in the knurl pattern in the crimp connection, a more robust electrical and mechanical connection of the wire cable and the electrical contact is attained over a service life of the vehicle.

Further features, uses and advantages of the invention will appear more clearly on a reading of the following detailed description of the invention, which is given by way of non-limiting example only and with reference to the accompanying drawings.

BRIEF DESCRIPTION OF THE DRAWINGS

This invention will be further described with reference to the accompanying drawings in which.

DETAILED DESCRIPTION

Figure 2:
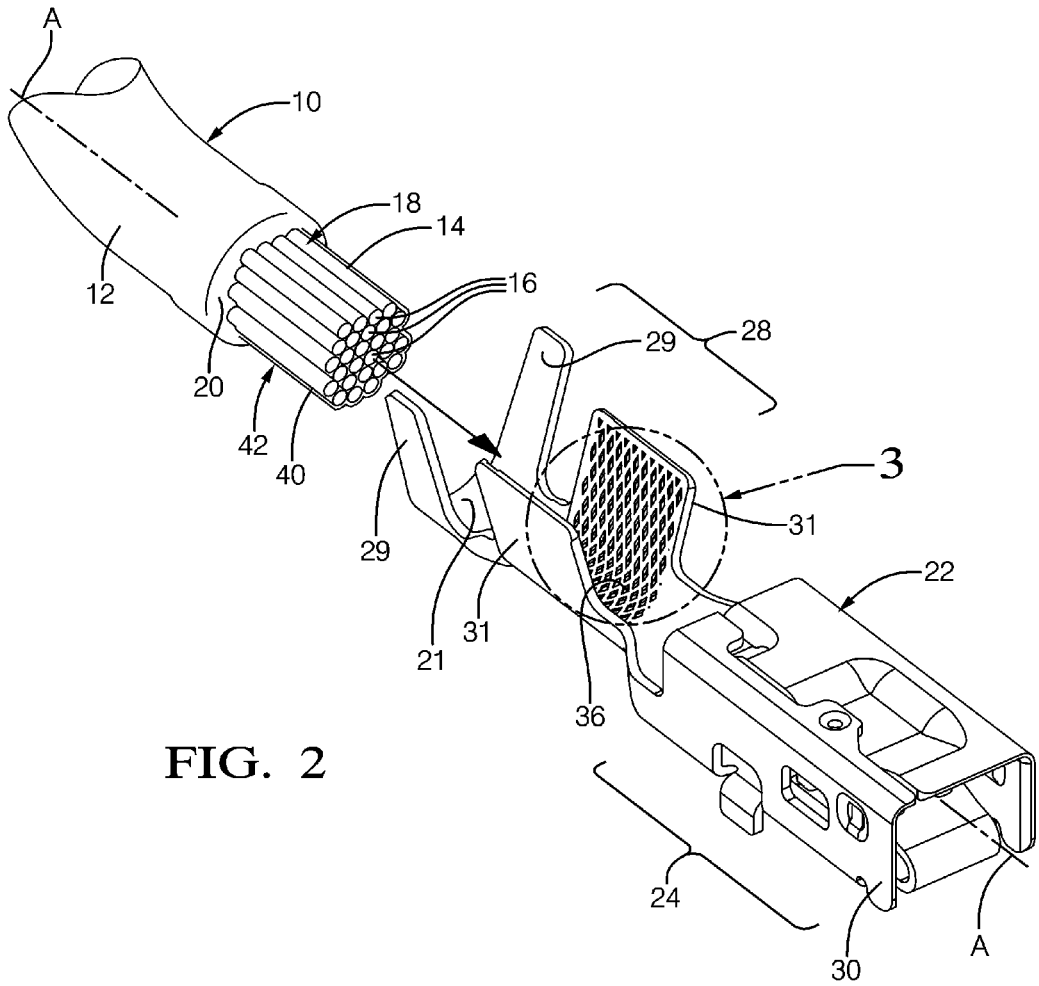
FIG. 2 is a perspective view of an electrical contact that includes a knurl pattern along a portion of a length of the electrical contact receiving a wire cable according to the invention.

In accordance with this invention, referring to FIG. 2, a wire conductor, or wire cable 10 is disposed along a longitudinal axis A. Cable 10 has an insulative outer cover 12 and an aluminum-based inner core 14. The term "aluminum-based" as used in this document herein is defined to mean pure aluminum or an aluminum alloy where aluminum is the main metal in the alloy. Cover 12 surrounds inner core 14. Inner core 14 is composed of wire strands that may be axially disposed in inner core 14 when inner core 14 is received in electrical contact 22. Alternately, inner core may be constructed of a plurality of individual wire strands that are bundled and twisted together. When the wire strands are twisted and bundled together, the lead may be axially received into the electrical contact, but the twisted wire strands may not be axially disposed therein. Wire strands 16 are useful to provide flexation of cable 10 when cable 10 is installed in a wiring application (not shown), such as during the manufacture of a vehicle. Alternately, the inner core of the wire cable may be a single wire strand. An end portion (not shown) of cover 12 of cable 10 is removed to expose a portion of inner core 14. Exposed portion of inner core 14 is a lead 18 of wire cable 10. Lead 18 extends from an axial edge 20 of cover 12.

Figure 3:
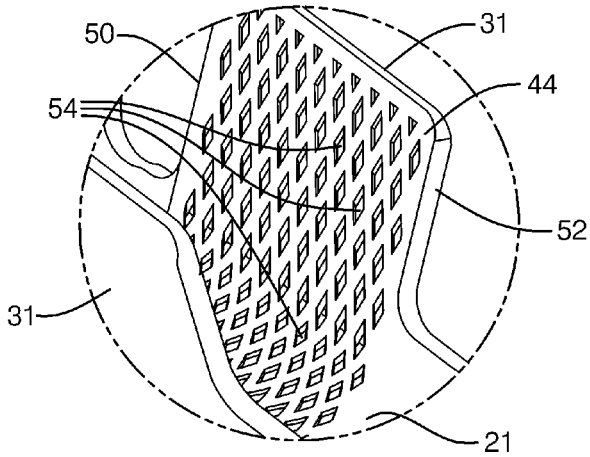
FIG. 3 shows a magnified view of the knurl pattern of FIG. 2, and details thereof.

A copper-based terminal or electrical contact 22 includes a mating end 24 and an open wing end 28. Wing end 28 receives lead 18 along an axis A. Wing end 28 includes a pair of insulation wings 29 and a pair of core wings 31 that are axially spaced apart from core wings 31. Insulation wings 29 are disposed aft of core wings 31 along a base 21 of electrical contact 22 that receives wire cable 10. The term "copper-based" as used in this document herein is defined to mean pure copper, or a copper alloy where copper is the main metal in the alloy. Electrical contact 22 may be received into a connector (not shown) that may include a plurality of electrical contacts (not shown) that are part of wiring harness (not shown) used in a vehicle (not shown) and the connector (not shown) may mate with a corresponding mating connector (not shown) used in the motorized vehicle. Mating end 24 contains a female box electrical contact 30 and as is known and used in the electrical contact and wiring arts. Female box contact 30 may be received into a corresponding male electrical contact (not shown), such as may be found in the corresponding mating connector (not shown) disposed in the vehicle (not shown). Female box contact 30 electrically joins an electrical signal carried on inner core 14 with another electrical circuit attached with the corresponding male receiving electrical contact. Alternately, the female mating end may be a male mating end and the electrical contact may comprise other additional sections disposed intermediate the wing and the mating end. Insulation wings 29 and core wings 31 respectively angularly extend outwardly away from base 21 of electrical contact 22. Base 21 preferably has an arcuate shape in the neutral state. The neutral state of electrical contact 22 is the form of electrical contact 22 after initial construction and before a crimp connection 46 is formed, as best illustrated in FIGS. 2 and 3. Arcuate base 21 generally conforms to a shape of lead 18 when wire cable 10 is received in electrical contact 22. Insulation wings 29 are configured to crimp to insulative outer cover 12 and core wings 31 are configured to crimp to lead 18.

Electrical contact 22 is chosen such that wing end 28 is of a sufficiently large size to receive lead 18 and portion of outer cover 12 adjacent to lead 18 to allow for an effective crimp between electrical contact 22 and cable 10. A core wing 31 is sized to sufficiently wrap around, cover, and engage against at least a portion of lead 18 when cable 10 is crimped to electrical contact 22. Core wing 31 includes an interior surface, or abutting surface 36 that engages at least a portion of inner core 14 of lead 18 when cable 10 is crimped to electrical contact 22 to provide electrical connection between cable 10 and electrical contact 22. Preferably, core wing 31 is sized to lead 18 so that knurl pattern 44 engages the entire length of lead 18 and a rearward edge 50 of electrical contact 22 is disposed adjacent to edge 20 of outer insulative layer 12 when crimp connection 46 is formed.

A fluid conformal coating 40 is disposed along at least an outer surface of lead 18 and an end 38 of lead 18. Additionally, coating 40 is also applied over edge 20 and extends on to a portion of insulative outer cover 12 adjacent lead 18. Thus, a seal covering 42 of fluid conformal coating 40 entombs lead 18 so as to provide a corrosion-resistant protective layer for lead 18 of cable 10 when wire cable 10 is received into wing end 28 of electrical contact 22. "Fluid" is defined as "being able to flow." Seal covering 42 may advantageously aid in the preventing the formation of galvanic corrosion in crimp connection 46. The viscosity of coating 40 may be altered to allow coating 40 to properly flow onto cable 10 so as to achieve a sufficient thickness of coating 40 to completely cover at least the outside surface of lead 18. Seal covering 42 of fluid coating 40 may be applied to cable 10 by dripping, spraying, electrolytic transfer, and brush and sponge applications, and the like. One such seal covering is described in U.S. application Ser. No. 12/883,838 entitled SEALED CRIMP CONNECTION METHODS filed on 16 Sep. 2010, and is incorporated by reference herein. Alternately, the lead may be void of any applied fluid coating.

Figure 4:
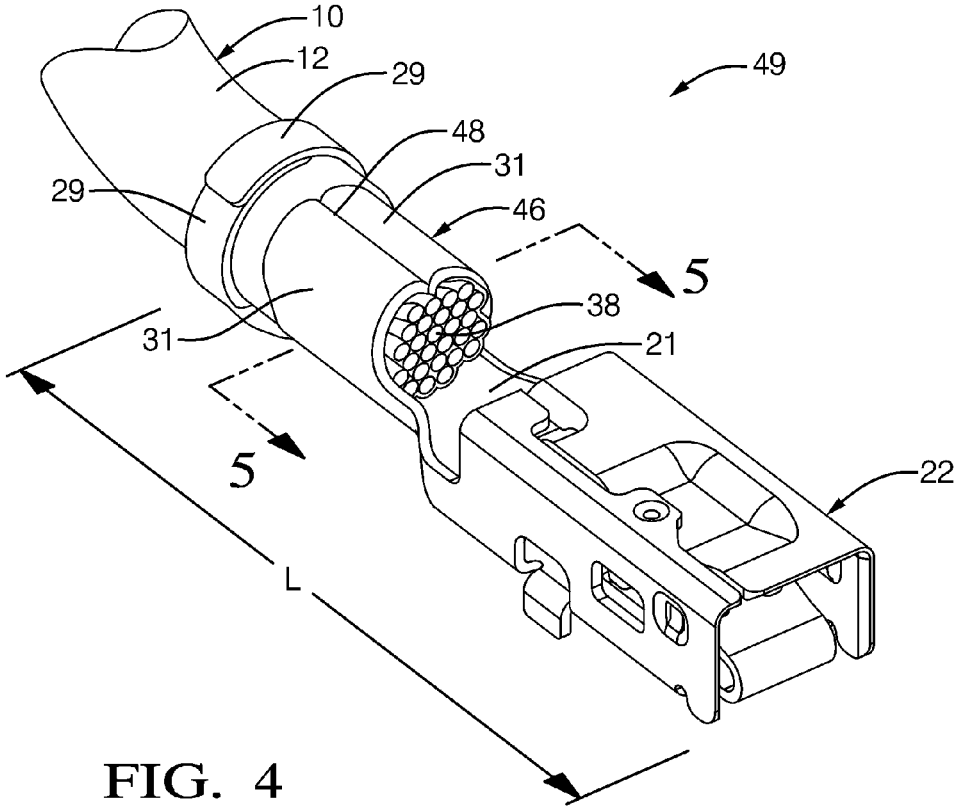
FIG. 4 shows a crimp connection that attaches the wire cable of FIG. 2 to the electrical contact of FIG. 2.
Figure 5:
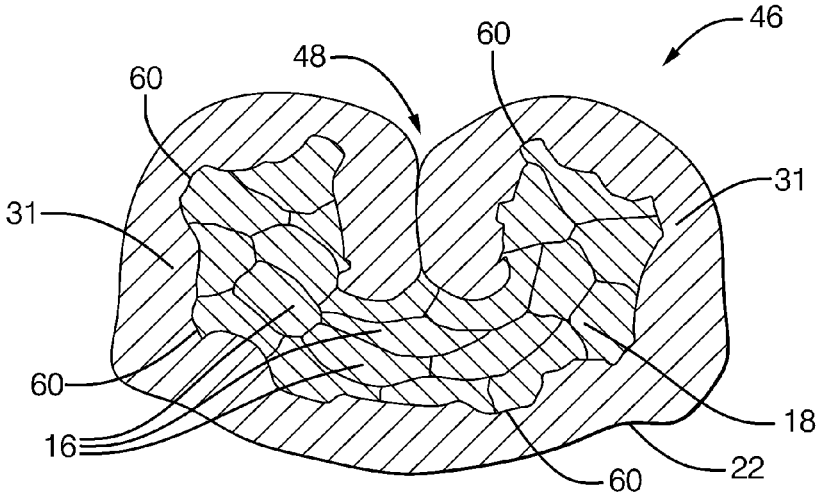
FIG. 5 shows a cross-sectional view of the crimp connection of FIG. 4, through the lines 5-5.

Referring to FIG. 3, electrical contact 22 includes a knurl pattern 44. Knurl pattern 44 is defined within abutting surface 36 of core wing 31 of electrical contact 22 along a portion of a length L of electrical contact 22. Length L is axially disposed along axis A. Referring to FIGS. 4-5, when electrical contact 22 is attached to wire cable 10 to form crimp connection 46, knurl pattern 44 engagingly contacts against at least the outer surface of lead 18. Knurl pattern 44 may be formed, and stamped in to interior surface 36 by using a die press, as is known in the electrical contact and wiring arts. Crimp connection 46 includes a seam 48 formed intermediate a rearward and forward edge 50, 52 of core wing 31. Crimp connection 46 is part of a wire assembly 49 that includes wire cable 10 and electrical contact 22.

Figure 6:
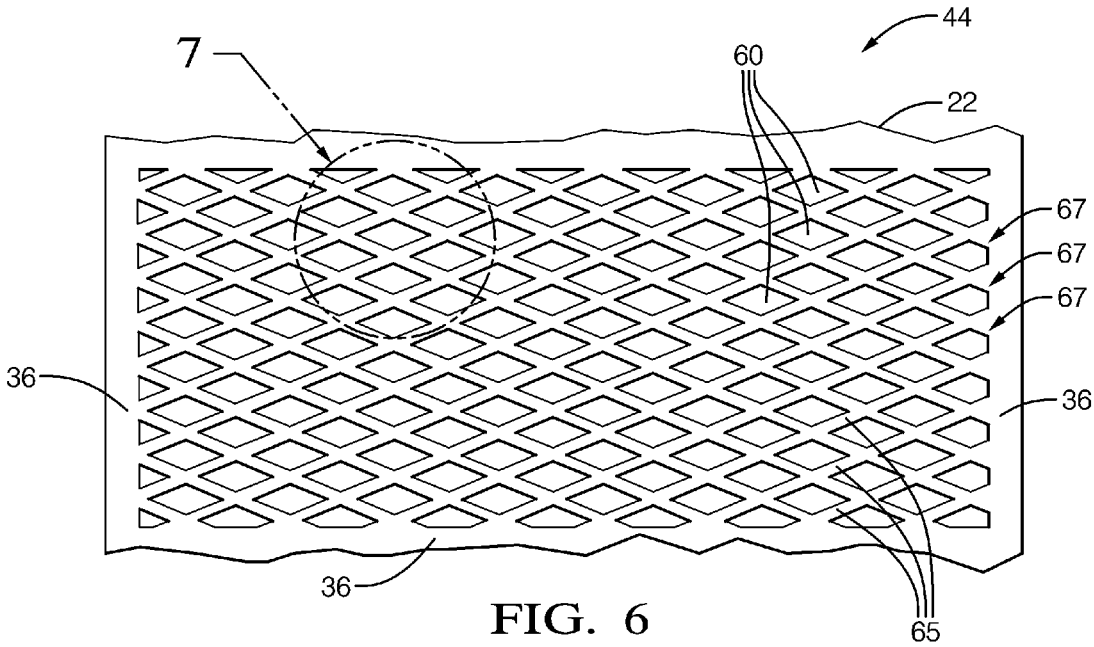
FIG. 6 shows a magnified view of the knurl pattern of FIG. 3, and details thereof.
Figure 7:
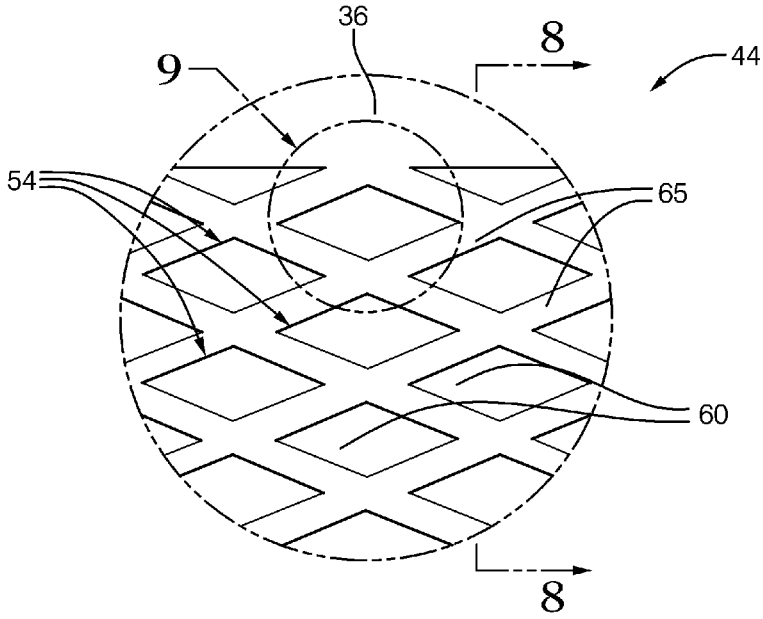
FIG. 7 shows a magnified view of recessed, rhomboid-shaped elements of the knurl pattern of FIG. 6.
Figure 8:
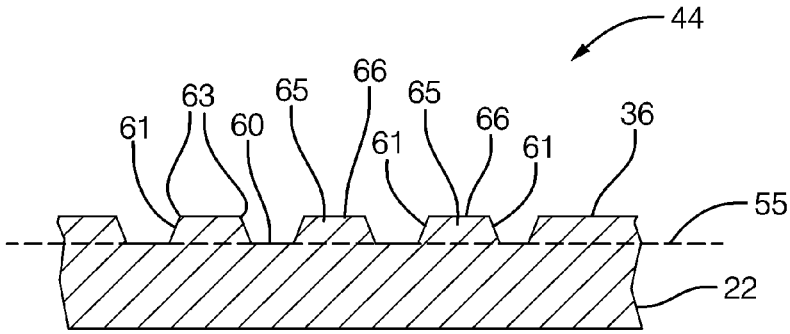
FIG. 8 shows a cross-sectional view of the recessed, rhomboid-shaped elements of FIG. 7 that include inclined ramp sidewalls, taken through the lines 8-8.
Figure 9:
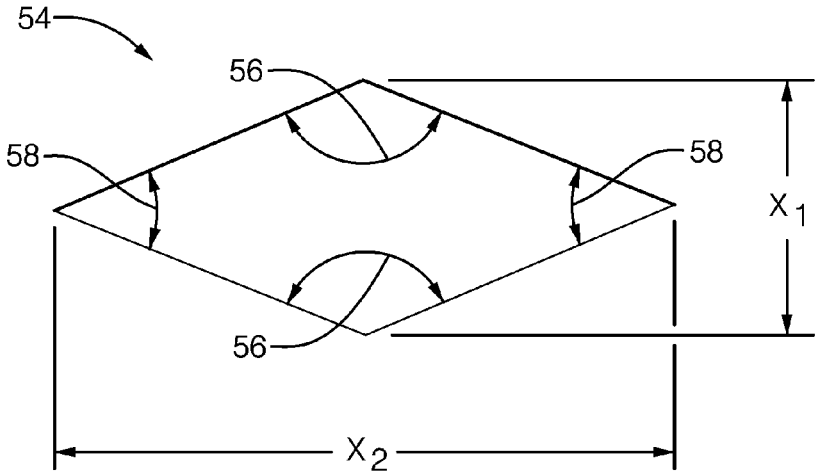
FIG. 9 shows a magnified view of a single, recessed rhomboid-shaped element in the plurality of recessed, rhomboid-shaped elements of FIG. 7.

Referring to FIGS. 6-9, knurl pattern 44 includes a plurality of elements 54 that extend along a floor 55 underlying abutting surface 36. A recessed surface 60 of each element 54 is adjacently disposed to floor 55. Floor 55 is spaced apart and recessed from abutting surface 36. Raised portions 65 are disposed in-between the elements 54 and have a top planar surface 66 that is generally planar with the surrounding abutting surfaces 36. Each of the plurality of elements 54 includes a plurality of sidewalls 61. Edges 63 of respective elements 54 are formed at an interface between sidewalls 61 and top planar surfaces 66 of raised portions 65. Each element 54 has a perimeter edge formed from a plurality of edges 63 that surround each element 54. Each sidewall in the plurality of sidewalls 61 for each element in the plurality of elements 54 extends from recessed surface 60 in an inclined, angled direction towards top planar surface 66 and transition to top planar surface 66 such that edges 63 are formed. Thus, sidewalls 61 are inclined ramps when viewed in cross section, as best illustrated in FIG. 8. Advantageously, plurality of inclined sidewalls 61 assist removal of the die from electrical contact 22 when knurl pattern is stamped. Preferably, the incline ramps of the sidewalls have draft angle that is an acute angle in relation to a plane defined perpendicular to floor 55. Alternately, the plurality of sidewalls for each element in the plurality of elements may be disposed in a direction perpendicular to the floor. Recessed surface 60 for each element 54 is generally parallel with abutting surface 36 and with axis A. Raised portions 65 adjacently surround each element 54 in knurl pattern 44, as best illustrated in FIGS. 7 and 8. The planar top surfaces 66 of raised portions 65 transitionally communicate with the surrounding abutting surface 36, as best illustrated in FIG. 6. Alternately, the planar top surfaces of the raised portions may be recessed so that the planar top surfaces are disposed intermediate the floor and the surrounding abutting surface. Edges 63 are effective to fracture the aluminum oxides disposed on lead 18 as crimp connection 46 is formed. The structure interrelationships of sidewalls 61, edges 63, and raised portions 65 are best illustrated in FIG. 8. Floor 55 has a spaced, generally parallel relationship with abutting surface 36. Each recessed surface 60 has a shape that includes a first pair of opposing, generally axial inner corners 56. First pair of opposing inner corners 56 define a first, or axial minor distance $x_1$ therebetween. A second pair of opposing inner corners 58 different from first pair of opposing inner corners 56 define a second, or major distance $x_2$ therebetween. Major distance $x_2$ has a bisecting, perpendicular relationship to minor distance $x_1$, as best illustrated in FIG. 9. Axial minor distance $x_1$ is less than major distance $x_2$. Recessed surface 60 for each element 54 has a surface area that forms a rhombus shape. Alternately, the axial minor distance may be substantially axial with axis A and the major distance is perpendicular to the substantial axial minor distance. For each element 54, first pair of axial opposing inner corners 56 respectively have an angular value that is greater than the angular value of the respective second pair of opposing inner corners 56. Preferably, an inner corner of the first pair of axial opposing inner corners 56 has an obtuse angular value and an inner corner of the second pair of opposing inner corners 58 has an acute angular value, as best illustrated in FIG. 9. In a further alternate embodiment, an inner corner of the first pair of axial opposing inner corners has an obtuse angular value that may be greater than 100 degrees.

The knurl pattern 44 of electrical contact 22 is not in use when wire cable 10 is not attached, as best illustrated in FIGS. 2 and 3.

Knurl pattern 44 of electrical contact 22 is in use when knurl pattern 44 engages lead 18 to form crimp connection 46, as best illustrated in FIGS. 4 and 5. Crimp connection 46 may be formed by a press as is known in the electrical contact and wiring arts. When crimp connection 46 is being formed, plurality of elements 54 are urged by a force as applied by the press to engage against aluminum lead 18 such that portions of aluminum lead 18 extrude into plurality of elements 54. The edges 61 in the plurality of elements 54 in combination with the axial minor distance $x_1$ and major distance $x_2$ rhombus shape orientation further assist to break up the aluminum oxides along the entire outer surface of lead 18 of cable 10 so as to increase the electrical and mechanical robustness of crimp connection 46.

Figure 1:
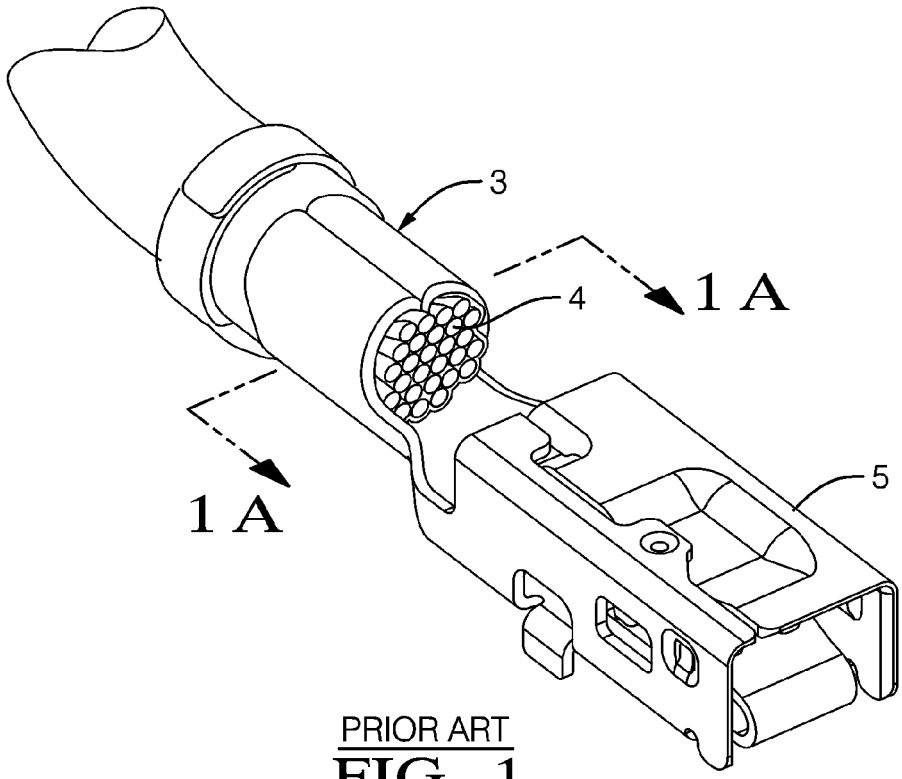
PRIOR ART FIG. 1
FIGS. 1 and 1A respectively show a prior art crimp that attaches a lead of a wire conductor to a terminal that includes voids in the knurl pattern of the terminal that do not contain portions of the lead.
Figure 1A:
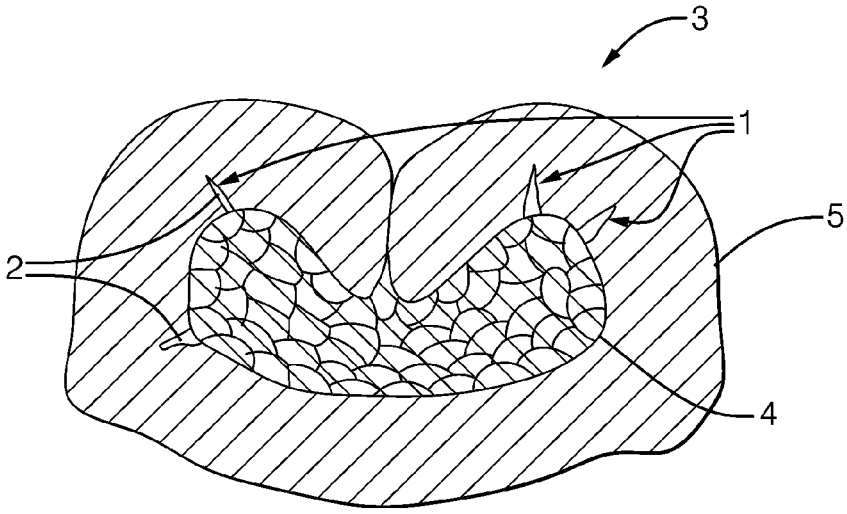
PRIOR ART FIG. 1 A

While not limited to any particular theory, it has been observed, that using plurality of elements 54 having the orientation of axial minor distance $x_1$ and major distance $x_2$ assists to keep elements 54 open for a longer period of time during the crimping of electrical contact 22 to lead 18. Portions of aluminum lead 18 extrude into elements 54 against recessed surfaces 60 so that elements 54 engagingly close against portions of the extruded aluminum lead 18 so that the voids (2), as shown in prior art FIG. 1A, do not occur. Because major axis distance $x_2$ is perpendicular to lead 18, a greater contact surface area for any particular wire strand 16 is more apt to have aluminum oxides disposed on individual wire strand 16 broken up and fractured while also being extruding into recessed elements 54. A greater contact surface area of pure aluminum on at least an outer surface of lead 18 making mechanical and electrical contact with the surface area material 36, 60, 61, 63, 66 of knurl pattern 44 on core wing 31 ensures a more reliable and robust electrical connection. The greater surface area contact also results in enhanced mechanical interlock between lead 18 and core wing 31 that assists to maintain the robust electrical contact between lead 18 and electrical contact 22 in crimp connection 46. This greater surface area contact between surfaces 36, 60, 61, 63, 66 and lead 18 is best illustrated in FIGS. 5 and 8. Thus, knurl pattern 44 advantageously allows for a maximum electrical and mechanical connection between lead 18 and electrical contact 22 when crimp connection 46 is formed. Moreover, it is also important that core wings 31 are crimped in a manner so that as crimp connection 46 is formed to a final state from the neutral state, core wing 31 maintains a generally arcuate form during the formation of crimp connection 46. The final state of core wing 31 is when core wing 31 is formed in crimp connection 46, as best illustrated in FIG. 4. Maintaining the arcuate form of core wing 31 during the crimping process allows elements 54 to bendingly remain sufficiently open for a longer time period such that portions of aluminum lead 18 extrude into elements 54 before elements 54 engagingly close partially to trap the extruded portions of aluminum lead 18 within the closed elements 54, as best illustrated in FIG. 5.

Additionally, as recessed elements 54 are formed in diagonal rows 67 when knurl pattern 44 is formed in interior surface 36 of core wing 31, the major distances $x_2$ collectively cover the width of core wing 22 such that at least the entire surface area of lead 18 is impacted by plurality of elements 54 across the length and width of knurl pattern 44 on core wings 31 to ensure a robust electrical connection of wire cable 10 and electrical conductor 22. The perimeter edges of the elements 54 in knurl pattern 44 are effective to provide increased ability for knurl pattern 44 to fracture aluminum oxides on lead 18 when crimp connection 46 is formed.

It has been observed when crimp connection 46 is analyzed and core wings 31 are unwrapped from lead 18, a substantial portion of knurl pattern 44 is left impressed in the outer surface of lead 18 of wire cable 10. For many analyzed crimp connections, one hundred percent (100%) of the knurl pattern is left impressed on the leads of the respective wire cables.

Figure 10:
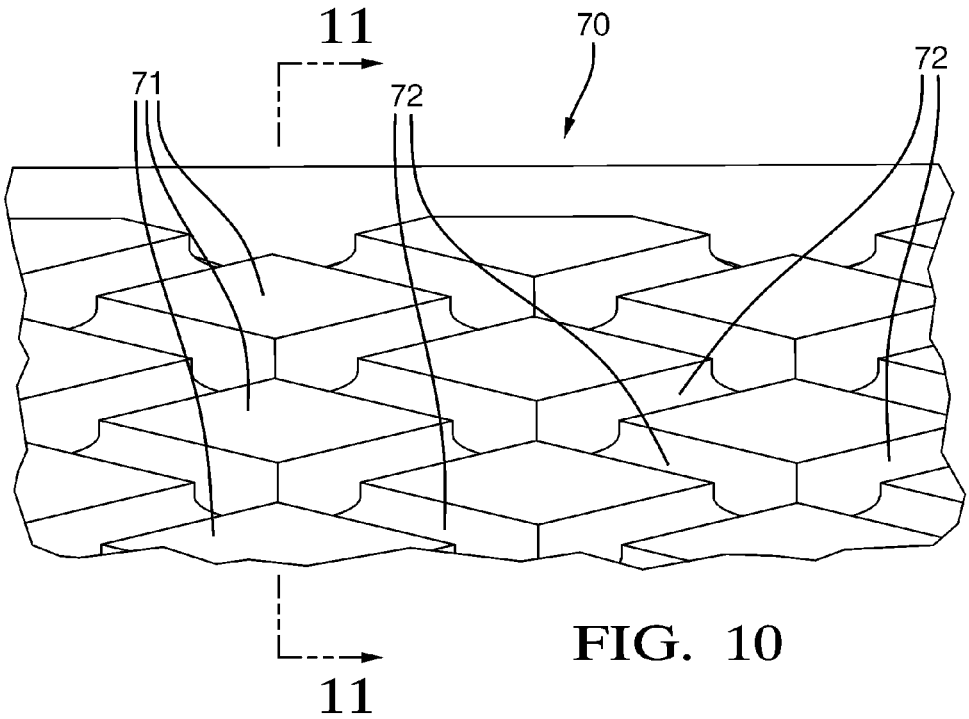
FIG. 10 shows an isometric three-dimensional view of corresponding raised protrusion elements associated with the die of the press tool used to construct the recessed, rhomboid-shaped elements of FIG. 7 in an interior surface of the electrical contact.
Figure 11:
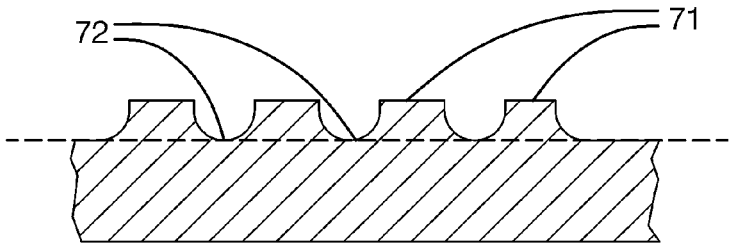
FIG. 11 shows a cross-sectional view of the corresponding elements of the die of the press tool of FIG. 10, along the lines 11-11.

Alternately, referring to FIGS. 10 and 11, a corresponding knurl pattern 70 is associated with a die of a die press (not shown) as is known and used in the electrical contact and wiring arts. To construct plurality of recessed elements 54 in knurl pattern 44 of electrical contact 22, raised rhomboid protrusions 71 of knurl pattern 70 are utilized on the die used in the die press. Grooves 72 surround each protrusion 71 in knurl pattern 70 disposed on the die. The die containing knurl pattern 70 is constructed from hardened metal that is harder than the electrical contact or terminal, such as using a hardened carbide steel. Grooves 72 preferably have a deeper depth than a depth of raised portions 65 of knurl pattern 44 as measured from floor 55.

Figure 12:
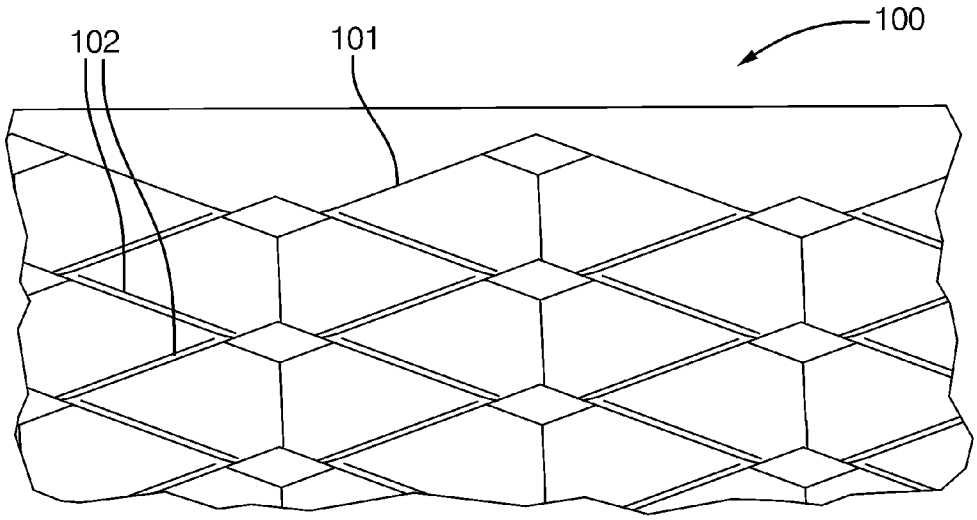
FIG. 12 shows an isometric three-dimensional view of corresponding elements associated with a die of a press tool used to make recessed, rhomboid-shaped pyramidal elements in an interior surface of an electrical contact, according to an alternate embodiment of the invention.

Alternately, referring to FIG. 12, a die employs pyramidal rhomboid-shaped protrusions 101 and associated adjacent grooves 102 may be utilized. Protrusions 101 each have a flattened truncated top. When the die employing pyramidal protrusions 101 and associated grooves 102 is used to stamp a recessed knurl pattern on the core wings and base of the electrical contact, a plurality of recessed pyramidal rhomboid-shaped elements is defined in the interior surface of the electrical contact. Each flattened truncated top is in each recessed pyramidal rhomboid-shaped element is disposed adjacent a floor of the interior surface of the electrical contact. The die of the embodiment of FIG. 12 is made from similar materials as the die of the embodiment shown in FIGS. 10 and 11 as previously discussed herein.

Alternately, the wire cable may be constructed from a non-aluminum, electrically conductive material and the electrical contact may be constructed from any suitable electrically conductive material.

Still yet alternately, the knurl pattern may be employed along any portion of the length and width of the interior surface of the electrical contact that makes contact with at least a portion of a lead of a wire cable.

In another alternate embodiment, the wire assembly may be associated with an electrical connection system used in any type of electrical application that requires a robust electrical connection.

In yet another alternate embodiment, the inner core of a wire cable may include a lead that has a plurality of wire strands that are compacted or welded together. One such welded lead is described in U.S. application Ser. No. 13/168,309 entitled CRIMP CONNECTION TO ALUMINUM CABLE filed on 24 Jun. 2011, which is incorporated by reference herein.

Thus, an electrical contact that includes a knurl pattern having a plurality of recessed rhombic elements has been presented. Each recessed rhombic element has an orientation relative to a wire cable received in the electrical contact that allows for an improved electrical and mechanical connection between the electrical contact and the aluminum wire cable. Each recessed rhombic element has an axial minor distance disposed between axial inner corners. Each rhombic element further includes a major distance disposed between non-axial inner corners. The axial minor distance is less than the major distance. The recessed rhomboid elements may be disposed along any amount of the interior surfaces of the electrical contact that axially receives a lead of the wire cable. The knurl pattern extends along a width of the core wings and along an arcuate base of the electrical contact defined in an interior surface of the electrical contact. The crimping process maintains the arcuate form of the base while also crimping the core wings in an arcuate form all that way from a neutral state to a final state as the crimp connection is constructed. This crimping process allows at least a substantial portion of the recessed rhomboid elements to fill with the extruded aluminum of the lead before the recessed rhomboid elements are partially closed to ensure voids, as shown in prior art FIG. 1A, do not occur. When a substantial portion of the recessed rhomboid elements are filled with pure aluminum where the pure aluminum makes complete contact with a substantial portion of the surface area of the recessed surface of the rhomboid elements, a greater surface contact area between the aluminum lead and electrical contact is realized that ensures an enhanced mechanical and electrical crimp connection is attained over the service life of the wire assembly. The increased perimeter distance of the summation of the edges in the plurality of elements of the knurl pattern in combination with the axial minor distance orientation of each rhomboid element ensure the aluminum oxides disposed on the lead of the wire cable are more effectively fractured and broken along at least the outer surface of the lead along the length of the lead that is encompassed by the knurl pattern when the crimp connection is formed.

While this invention has been described in terms of the preferred embodiment thereof, it is not intended to be so limited, but rather only to the extent set forth in the claims that follow.

It will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its embodiments, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

We claim:

1. An electrical contact comprising:

a knurl pattern defined in an interior surface of the electrical contact along a portion of a length of the electrical contact, the length being disposed along a longitudinal axis and the portion configured to axially receive a lead of a wire cable for attachment thereto, thereby allowing the lead to engagingly contact the knurl pattern, the knurl pattern including a plurality of elements, each element in the plurality of elements has a shape that includes a plurality of inner corners, a first pair of opposing inner corners defining a minor axis and a minor distance therebetween and a second pair of opposing inner corners different from said first pair of opposing inner corners defining a major axis and a major distance therebetween, wherein said minor axis is axial with said longitudinal axis and said major axis is perpendicular to said longitudinal axis and wherein said minor distance is less than said major distance, wherein each element in the plurality of elements includes a surface having a spaced, recessed relationship to said interior surface.

2. The electrical contact according to claim 1, wherein the surface of each element in the plurality of elements is disposed adjacent a floor of the portion and wherein the floor has a parallel, spaced relationship with the interior surface.

3. The electrical contact according to claim 1, wherein the major axis is perpendicular to said minor axis.

4. The electrical contact according to claim 1, wherein the first pair of opposing inner corners respectively have an obtuse angular value, and the second pair of opposing inner corners respectively have an acute angular value.

5. The electrical contact according to claim 1, wherein the plurality of elements comprise sidewalls, and said sidewalls include inclined ramps.

6. The electrical contact according to claim 1, wherein each element in the plurality of elements includes a surface having an area that forms a rhombus shape.

7. The electrical contact according to claim 6, wherein a rhombus-shaped surface of each element in the plurality of elements has a spaced, recessed relationship to said interior surface.

8. The electrical contact according to claim 7, wherein at least an outer surface of the lead is engaged against a substantial portion of the rhombus-shaped surface in each element in the plurality of elements.

9. The electrical contact according to claim 1, wherein the electrical contact comprises a base configured to receive the lead of the wire cable, and the base has an arcuate shape, and the knurl pattern is disposed along at least a portion of the base.

10. The electrical contact according to claim 9, wherein when the lead is attached to the portion of the electrical contact, a crimp connection is formed between the lead and the wire cable.

11. The electrical contact according to claim 10, wherein an inner core of said wire cable includes said lead and said inner core is aluminum-based, and the plurality of elements include recessed external surfaces in relation to said interior surface, and when the crimp connection is formed, the lead is urged against a substantial portion of said recessed external surfaces associated with the plurality of elements.

12. The electrical contact according to claim 10, wherein the crimp connection is associated with a cable harness disposed in a motorized vehicle.

13. An electrical connection system comprising:

at least one connector that includes one or more electrical contacts and the one or more electrical contacts are in electrical connection with one or more wire cables, and at least one of the one or more electrical contacts includes, a knurl pattern defined in an interior surface of an electrical contact along a portion of a length of the electrical contact, the length being disposed along a longitudinal axis and the portion configured to axially receive a lead of a wire cable for attachment thereto, thereby allowing the lead to engagingly contact the knurl pattern, the knurl pattern including a plurality of elements, each element in the plurality of elements has a shape that includes a plurality of inner corners, a first pair of opposing inner corners defining a minor axis and a minor distance therebetween and a second pair of opposing inner corners different from said first pair of opposing inner corners defining a major axis and a major distance therebetween, wherein said minor axis is axial with said longitudinal axis and said major axis is perpendicular to said longitudinal axis and wherein said minor distance is less than said major distance, wherein each element in the plurality of elements includes a surface having a spaced, recessed relationship to said interior surface.

14. The electrical connection system according to claim 13, wherein the one or more wire cables are formed of aluminum.

15. The electrical connection system according to claim 13, wherein said one or more electrical contacts in electrical connection with the one or more wire cables are associated with a wiring harness disposed in a motorized vehicle.

16. The electrical connection system according to claim 13, wherein each element in the plurality of elements includes a surface that comprises a rhombus shape.

17. The electrical connection system according to claim 16, wherein a rhombus-shaped surface of each element in the plurality of elements has a spaced, recessed relationship to said interior surface.

* * * * *